United States Patent [19]

Fitzgerald

[11] 4,089,688

[45] May 16, 1978

[54] POLYMERIC N-ALKENYL CARBAMATE SILVER HALIDE PEPTIZER

[75] Inventor: Maurice J. Fitzgerald, Canton, Mass.

[73] Assignee: Polaroid Corporation, Cambridge, Mass.

[21] Appl. No.: 805,864

[22] Filed: Jun. 13, 1977

Related U.S. Application Data

[63] Continuation-in-part of Ser. No. 638,819, Dec. 8, 1975, abandoned, which is a continuation-in-part of Ser. No. 548,898, Feb. 11, 1975, abandoned, which is a continuation-in-part of Ser. No. 337,432, Mar. 2, 1973, abandoned.

[51] Int. Cl.[2] ..... G03C 1/72

[52] U.S. Cl. ..... 96/114

[58] Field of Search ..... 96/114

[56] References Cited

U.S. PATENT DOCUMENTS

| | | | |
|---|---|---|---|
| 2,772,166 | 11/1956 | Fowler | 96/114 |
| 2,798,063 | 7/1957 | Fowler et al. | 96/114 |
| 2,808,331 | 10/1957 | Unkuh et al. | 96/114 |
| 2,831,767 | 4/1958 | Dann et al. | 96/114 |
| 2,852,382 | 9/1958 | Illingsworth et al. | 96/114 |
| 3,150,977 | 9/1964 | Hart et al. | 96/114 |
| 3,488,708 | 1/1970 | Smith | 96/114 |
| 3,512,985 | 5/1970 | Harvey | 96/114 |
| 3,516,830 | 6/1970 | Whiteley | 96/114 |
| 3,628,957 | 12/1971 | Franco et al. | 96/114 |
| 3,706,564 | 12/1972 | Hollister et al. | 96/114 |

*Primary Examiner*—Jack P. Brammer

*Attorney, Agent, or Firm*—Esther A. H. Hopkins

[57] ABSTRACT

A photosensitive silver halide emulsion preferably gelatin-free wherein the emulsion peptizer comprises an N-alkenyl carbamate polymer or copolymer.

20 Claims, No Drawings

POLYMERIC N-ALKENYL CARBAMATE SILVER HALIDE PEPTIZER

This application is a continuation-in-part of copending application Ser. No. 638,819 filed Dec. 8, 1975 now abandoned which was a continuation-in-part of application Ser. No. 548,898 filed Feb. 11, 1975, now abandoned, which was a continuation-in-part of application Ser. No. 337,432 filed Mar. 2, 1973 now abandoned.

BACKGROUND OF THE INVENTION

This invention relates to photography and more particularly, to novel photosensitive photographic elements, particularly novel photosensitive emulsions.

As a result of the known disadvantages of gelatin, in particular, its variable photographic properties and its fixed physical properties, for example, its diffusion characteristics, much effort has been expended in the past in order to replace gelatin with a suitable synthetic grain-growing protective colloid for photographic silver halide emulsions. Many synthetic polymeric materials have heretofore been suggested as peptizers for silver halide emulsions. However, these have generally not functioned satisfactorily and frequently have not fulfilled all of the basic requirements for a photosensitive silver halide emulsion grain-growing protective colloid, which include:

(1) absent (or constant) photographic activity;
(2) ability to form an adsorption layer on microcrystals of silver halide permitting stable suspensions to be obtained;
(3) ability to form adsorption layers as described in (2) above which do not prevent growth of silver halide microcrystals during physical ripening; and
(4) solubility in water.

In addition, heretofore, much emphasis has been placed on the ability of the synthetic polymeric material to mix with gelatin, as this property has been critical for employment in partial substitution reactions with gelatin. Consequently, many synthetic polymers of the prior art have been materials which allow for the growth of silver halide crystals only in the presence of gelatin.

Vinyl polymers comprising carbamate appendages affixed to a polyvinyl alcohol chain have been employed as vehicles and peptizers in photographic silver halide emulsions, as disclosed in Abel et al., U.S. Pat. No. 3,597,215 and Dann et al., U.S. Pat. No. 2,882,161. The above polymers have the carbamate appendage affixed to the polymeric backbone through an oxygen atom and therefore differ from the polymers of the instant invention in which the carbamate appendage is affixed to the polymeric backbone through a nitrogen atom.

Condensation products of polyalkylene oxide and N-[(dialkylamino)alkyl]carbamates have been found useful in obtaining halftone dot images of high edge gradient when incorporated in gelatino silver halide emulsions, as shown in Hayakawa et al., U.S. Pat. No. 3,288,612. Certain copolymers having N-vinyl heterocyclic carbamate monomers, particularly N-vinyloxazolidones, have been employed as flocculating agents in the manufacture of gelatino silver halide emulsions by the fluocculation method, as disclosed in Schaller et al., U.S. Pat. No. 3,360,373. Dersh U.S. Pat. Nos. 3,006,762 and 3,060,028 disclose the stabilizing and sensitizing properties of poly-N-vinyl-2-oxazolidinone polymers when added to silver halide emulsions which contain gelatin or another colloidal carrier. Casalgrasso et al. U.S. Pat. No. 3,628,957 discloses that N-alkenyl carbamate/acrylamide copolymers result in improved covering power of developed silver, increased contrast and good sensitivity when included in silver halide emulsions containing gelatin. However, gelatin-free silver halide emulsions employing N-alkenyl carbamate polymers as the grain-growing protective colloid have heretofore been unknown to the art.

SUMMARY OF THE INVENTION

The present invention is directed to a photosensitive silver halide emulsion, wherein the silver halide crystals have adsorbed on their surfaces a substantially continuous layer of a water-soluble film-forming polymeric silver halide grain-growing protective colloid having in its structure at least about 0.5 mole percent repeating units represented by the formula:

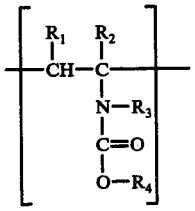

wherein $R_1$ is hydrogen, a lower alkyl group, i.e., 1–4 carbon alkyl group, preferably methyl or ethyl, or a halogen, i.e., chlorine, bromine or iodine; $R_2$ is hydrogen, a lower alkyl group, a halogen or cyano group; $R_3$ is hydrogen, a lower alkyl or a lower cycloalkyl group, i.e., a 3–7 cycloalkyl group; and $R_4$ is a lower alkyl or lower cycloalkyyl group; or a combination of $R_3$ and $R_4$ represents the atoms necessary to complete a heterocyclic ring structure. The above-described polymers are herein designated for convenience as N-alkenyl carbamate polymers.

DETAILED DESCRIPTION OF THE INVENTION

As indicated, the present invention is directed to photosensitive silver halide emulsions wherein photosensitive silver halide crystals have adsorbed on their surfaces at least a substantially continuous layer of a water-soluble film-forming N-alkenyl carbamate polymer having in its structure at least about 0.5 mole percent repeating units represented by the formula set forth above. The term "film-forming" is intended to designate a molecular weight sufficiently high to form a film, for example, a molecular weight comparable to that of gelatin (i.e., around 15,000).

Adsorption of this layer of synthetic grain-growing protective colloid on the surface of the silver halide crystal as the crystal is formed occurs because the synthetic colloid is used as the sole emulsifying agent during the precipitation of the silver halide crystal. As the crystal is formed, a substantially continuous layer is directly adsorbed on the surface. When the desired degree of ripening has been reached, other "bodying" polymers which determine overall diffusion characteristics of the bulk emulsion may be added, but the crystal growth, the crystal habit and, indeed, the major properties of the silver halide grain are determined by the polymer directly adsorbed on the surface, in this invention, the N-alkenyl carbamate polymer detailed above.

Such polymers have been found to effectively peptize silver halide emulsions in the absence of gelatin and to substantially meet all the basic requirements for a gelatin substitute without processing the deficiencies of gelatin as delineated above. The emulsions of the present invention are more stable against degradation than gelatin; in particular they are more stable against hydrolysis of the polymeric backbone in acidic or basic media. This stability is due, in large part, to the carbon-carbon linkages in the backbone of the instant polymers as opposed to the relatively easily hydrolyzable amide or ester linkages found in the polymeric backbone of gelatin. The polymers of this invention also show a resistance to the growth of microorganisms which is not exhibited by gelatin.

As examples of monomers represented by the formula:

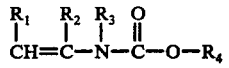

wherein $R_1$, $R_2$, $R_3$, and $R_4$ have the above-indicated definitions and which are contemplated as being suitable for providing the N-alkenyl carbamate polymers of the instant invention, mention may be made of the following:

1.
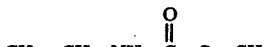
N-vinylmethylcarbamate

2.
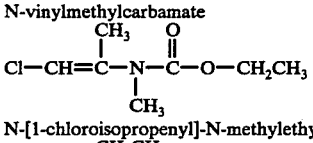
N-[1-chloroisopropenyl]-N-methylethylcarbamate

3.
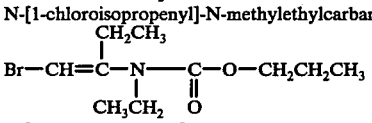
N-[1-bromo-2-butenyl]-N-ethyl-n-propylcarbamate

4.
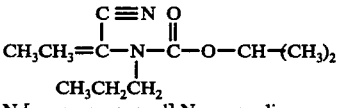
N-[α-cyanopropenyl]-N-n-propylisopropylcarbamate

5.
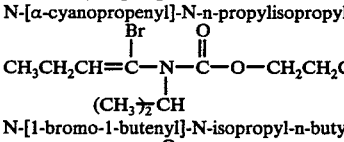
N-[1-bromo-1-butenyl]-N-isopropyl-n-butylcarbamate

6.
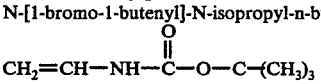
N-vinyl-tertiary butylcarbamate

7.
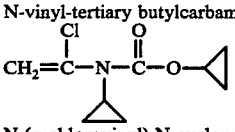
N-(α-chlorovinyl)-N-cyclopropylcyclopropylcarbamate

8.
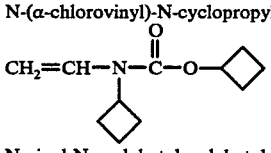
N-vinyl-N-cyclobutylcyclobutylcarbamate

9.
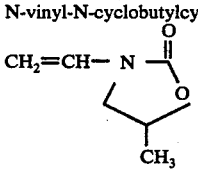

-continued

N-vinyl-5-methyl-2-oxazolidinone

10.
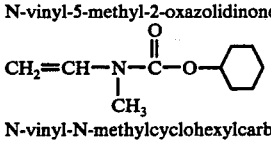
N-vinyl-N-methylcyclohexylcarbamate

The instant polymers may be homopolymers or interpolymers having, in addition to the repeating units defined above, any compatible repeating unit or various repeating units which are not detrimental to photographic silver halide emulsions and which allow the resultant polymer to be soluble in water. Examples of typical comonomers which may be employed in forming the polymers suitable for use in the present invention include the following ethylenically-unsaturated monomers.

11. $CH_2=CH-COOH$
acrylic acid

12. $CH_2=C(CH_3)-COOH$
methacrylic acid

13. $CH_2=C(Cl)-COOH$
α-chloroacrylic acid

14. $CH_2=C(Br)-COOH$
α-bromoacrylic acid

15. $CH_3CH=CH-COOH$
crotonic acid

16. $CH_3CH=CH-COOH$
isocrotonic acid

17. $Cl-CH=CH-COOH$
β-chloroacrylic acid

18. $Br-CH=CH-COOH$
β-bromoacrylic acid

19. $Cl-CH=C(CH_3)-COOH$
β-chloromethacrylic acid

20. $CH_2=CH-COO-CH_3$
methyl acrylate

21. $CH_2=C(CH_3)-COO-CH_2CH_3$
ethyl methacrylate

22. $CH_2=C(Cl)-COO-CH_2CH_2CH_3$
n-propyl-α-chloroacrylate

23. $Br-CH=CH-COO-CH(CH_3)_2$
isopropyl-β-bromoacrylate

24. $CH_2=C(CH_3)-COO-CH_2CH(CH_3)_2$
isobutyl methacrylate

25. $CH_2=CH-COO-CH_2CH_2OH$
β-hydroxyethyl acrylate

26. $CH_2=CH-COO-CH_2CH_2CH_2OH$
γ-hydroxypropyl acrylate

27. $CH_2=C(CH_3)-COO-CH_2CH(OH)CH_3$
2-hydroxy-n-propyl methacrylate

28. $CH_2=CH-CO-NH_2$
acrylamide

29. $CH_2=C(Cl)-CO-NH_2$
α-chloroacrylamide

30. $CH_2=C(Br)-CO-NH_2$
α-bromoacrylamide

31. $CH_2=C(CH_3)-CO-NH_2$
methacrylamide

-continued

32. $CH_2=C(CH_2CH_3)-CO-NH_2$
α-ethylacrylamide

33. $Cl-CH=C(CH_3)-CO-NH_2$
β-chloromethacrylamide

34. $Br-CH=C(Br)-CO-NH_2$
2,3-dibromoacrylamide

35. $CH_3CH=CH-CO-NH_2$
crotonamide

36. $CH_2=C(CH_3)-CO-NH-CH_3$
N-methylmethacrylamide

37. $CH_2=CH-CO-N-(CH_3)_2$
N,N-dimethylacrylamide

38. $CH_2=C(Cl)-CO-NH-CH_2CH_3$
N-ethyl-α-chloroacrylamide

39. $CH_2=CH-CO-NH-C-(CH_3)_3$
N-tertiary butylacrylamide

40. $CH_2=CH-CO-NH-$ 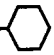
N-cyclohexylacrylamide

41. $CH_2=CH-CO-NH-C(CH_3)_2-CH_2-C-(CH_3)_3$
N-tertiary octyl acrylamide

42. $CH_2=CH-CO-NH-CH_2OH$
N-methylolacrylamide

43. $CH_2=CH-CO-NH-CH_2CH_2OH$
N-(β-hydroxyethyl) acrylamide

44. $CH_2=CH-CO-NH-C(CH_3)_2-CH_2-C(=O)-CH_3$
diacetone acrylamide

45. $CH_2=CH-CO-NH-CH-(CH_3)_2$
N-isopropylacrylamide

46. $CH_2=CH-CO-NH-CH_2-$ 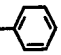
N-benzylacrylamide

47. $CH_2=CH-O-CH_3$
methylvinyl ether

48. $CH_2=C(Cl)-O-CH_2CH_3$
ethyl α-chlorovinyl ether

49. $CH_2=CH-O-CH_2CH_2Cl$
β-chloroethyl vinyl ether

50. $CH_2=CH-O-CH_2CH_2-OCH_3$
β-methoxyethyl vinyl ether

51. $CH_2=C(CH_3)-O-CH_2CH-(CH_3)_2$
isobutyl isopropenyl ether

52. $CH_2=CH-O-CH_2CH_2CH_2CH_2CH_2-CH-(CH_3)_2$
isooctyl vinyl ether

53. $CH_2=CH-C(=O)-CH_3$
methylvinyl ketone

54. $CH_2=C(CH_3)-C(=O)-CH_2CH_3$
ethyl isopropenyl ketone

55. $CH_2=C(Cl)-C(=O)-CH_2CH_2CH_3$
n-propyl-α-chlorovinyl ketone

56. $CH_2=C(Br)-C(=O)-CH_2CH_2-O-CH_3$
β-methoxyethyl-α-bromovinyl ketone

57. $CH_2=C(CH_2CH_3)-C(=O)-CH_2CH_2OH$
β-hydroxyethyl-1-butene-2-yl ketone

58. $CH_2=CH-CHO$
acrolein

-continued

59. $CH_3-CH=CH-CHO$
crotonaldehyde

60. $CH_2=C(Cl)-CHO$
α-chloroacrolein

61. $CH_2=C(Br)-CHO$
α-bromoacrolein

62. $CH_2=CH-C\equiv N$
acrylonitrile

63. $CH_3CH=CH-C\equiv N$
crotonoritrile

64. $CH_2=C(Cl)-C\equiv N$
α-chloroacrylonitrile

65. $CH_2=C(Br)-C\equiv N$
α-bromoacrylonitrile

66. $BrCH=C(CH_3)-C\equiv N$
β-bromomethacrylonitrile

67. $ClCH=C(CH_2CH_3)-C\equiv N$
β-chloroethacrylonitrile

68. $CH_2=C(C\equiv N)-COO-CH_3$
methyl α-cyanoacrylate

69. $CH_2=CH-CO-NH-CH_2-CO-NH_2$
acrylamidoacetamide

70. $CH_2=C(CH_3)-CO-NH-CH_2-CO-NH_2$
methacrylamidoacetamide

71. $CH_3CH=CH-CO-NH-CH(CH_3)-CO-NH-CH_3$
2-crotonamido-N-methylpropionamide

72. $CH_2=CH-CO-NH-CH(CH_3)-CO-NH_2$
2-acrylamidopropionamide

73. $CH_2=C(CH_3)-CO-NH-CH(CH_3)-CO-NH_2$
2-methacrylamidopropionamide

74. $CH_2=C(Cl)-CO-NH-CH(CH(CH_3)_2)-CO-NH_2$
2-(α-chloroacrylamido)-3-methylbutyramide 75. $CH_2=CH-CO-NH-CH_2-NH-CO-CH_3$
N-(acetamidomethyl)acrylamide 76. $CH_2=C(CH_3)-CO-NH-CH_2-NH-CO-CH_2CH_3$
N-(propionamidomethyl)methacrylamide 77. $CH_2=C(Cl)-CO-NH-CH_2-NH-CO-CH_2CH_2CH_3$
N-(n-butyramidomethyl) α-chloroacrylamide 78. 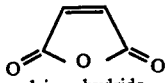
maleic anhydride 79. $HOOC-CH=CH-COOH$
maleic acid 80. $HOOC-CH=CH-CO-NH_2$
maleic acid amide 81. $HOOC-CH=CH-CO-NH-CH_2CH_3$
N-ethylmaleic acid amide 82. $CH_3-OOC-CH=CH-CO-NH-CH_3$
N-methyl methylmaleate amide 83. $CH_2=CH-OOCH$
vinylformate 84. $CH_2=CH-OOC-CH_3$
vinyl acetate 85. $CH_2=CH-OH$ (obtained by hydrolyzing copolymerized vinyl acetate)

-continued vinyl alcohol

86. $CH_2{=}C(CH_3){-}OOC{-}CH_2Br$ isopropenyl bromoacetate

87. $CH_2{=}CH{-}OOC{-}C(CH_3)_3$ vinyl pivalate

88. $CH_2{=}CH{-}NH{-}COO{-}C(CH_3)_3$

N-vinyl-tertiary butylcarbamate

89. $CH_2{=}C(COOH){-}CH_2{-}COO{-}CH_2CH_3$ ethyl-3-carboxy-3-butenate

90.

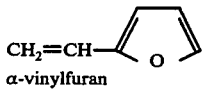

α-vinylfuran

91.

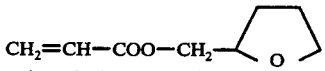

α-(acryloyloxymethyl)-tetrahydrofuran

92.

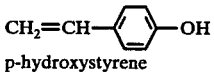

p-hydroxystyrene

93.

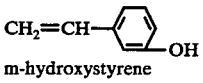

m-hydroxystyrene

94.

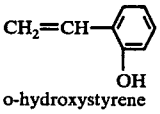

o-hydroxystyrene

95.

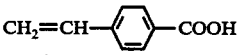

p-carboxystyrene

96.

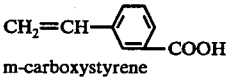

m-carboxystyrene

97.

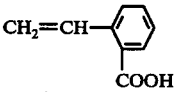

o-carboxystyrene

98.

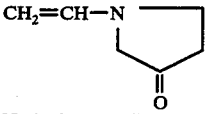

N-vinyl-2-pyrrolidone

99. $CH_2{=}CH{-}CO{-}NH{-}CH_2CH_3$

N-ethylacrylamide

100. $CH_2{=}CH{-}CO{-}NH{-}CH(COOH){-}CH{-}(CH_3)_2$

N-acryloylvaline

101. $CH_2{=}CH{-}CO{-}NH{-}CH(COOH){-}CH_2{-}CH_2{-}S{-}CH_3$

N-acryloylmethionine

102. $CH_2{=}CH{-}CO{-}NH{-}CH(CO{-}NH_2){-}CH_2{-}CH_2{-}S{-}CH_3$

N-acryloylmethionamide

103. $CH_2{=}C(CH_3){-}CO{-}NH{-}CH(COOH){-}CH_2{-}CH_2{-}S{-}CH_3$

N-methacryloylmethionine

Polymerization of the indicated monomers is achieved by conventional free radical polymerization techniques.

The following non-limiting examples illustrate the preparation of polymers within the scope of the present invention. The numerical ratio before the word "copolymer" in the following examples refers to the molar ratio of monomers in the reaction mixture forming the copolymer.

EXAMPLE I

1:1 copolymer of acrylamide/N-vinyl-t-butylcarbamate 3.56 g of acrylamide and 7.15 g of N-vinyl-t-butylcarbamate were dissolved in 90 mls of benzene. 0.01 g of 2,2'-azobis-[2-methylpropionitrile] was added and the solution was polymerized under $N_2$ in a sealed tube for 24 hours. The resultant viscous liquid was precipitated in acetone and the precipitate was separated and dried under vacuum at 50° C.

EXAMPLE II

2:3 copolymer of vinyl alcohol and N-vinyl-5-methyl-2-oxazolidinone

The copolymer of polyvinyl acetate and poly-N-vinyl-5-methyl-2-oxazolidinone (commercially available from Dow Chemical Company, Midland, Michigan, under the designation "Develex 130") was hydrolyzed in methanol with sodium methoxide. The resultant polymer was precipitated into acetone, separated and dried.

The following general procedure may be used for preparing photographic emulsions using the above-described polymers of the instant invention as the grain-growing protective colloids.

A water-soluble silver salt, such as silver nitrate, may be reacted with at least one water-soluble halide, such as potassium, sodium, or ammonium bromide, preferably together with potassium, sodium or ammonium iodide, in an aqueous solution of the polymer. The emulsion of silver halide thus-formed contains water-soluble salts, as a by-product of the double decomposition reaction, in addition to any unreacted excess of the initial salts. To remove these soluble materials, the emulsion may be centrifuged and washed with distilled water to a low conductance. The emulsion may then be redispersed in distilled water. To an aliquot of this emulsion may be added a known quantity of a solution of bodying or thickening polymer, such as polyvinyl alcohol having an average molecular weight of about 100,000 (commercially available from E. I. duPont deNemours & Company, Wilmington, Delaware, designated Type 72-60). A surfactant, such as dioctyl ester of sodium sulfosuccinic acid, designated Aerosol OT, (commercially available from American Cyanamid Company, New York, New York), may be added and the emulsion coated onto a film base of cellulose triacetate sheet having a coating of hardened gelatin.

Alternatively, the soluble salts may be removed by adding to the emulsion a solution of polyacid, such as 1:1 ethylene: maleic acid copolymer, and lowering the pH to below 5, thereby bringing about precipitation of the polyacid carrying the silver halide grains along with the precipitate. The resulting precipitate may then be washed and resuspended by redissolving the polyacid at pH 6–7.

The emulsions may be chemically sensitized with sulfur compounds such as sodium thiosulfate or thiourea, with reducing substances such as stannous chloride; with salts of noble metals such as gold, rhodium and platinum; with amines and polyamines; with quaternary ammonium compounds such as alkyl α-picolinium bromide; and with polyethylene glycols and derivatives thereof.

The emulsions of the present invention may also be optically sensitized with cyanine and merocyanine dyes. Where desired, suitable antifoggants, toners, restrainers, developers, accelerators, preservatives, coating aids, plasticizers, hardeners and/or stabilizers may be included in the composition of the emulsion.

The emulsions of this invention may be coated and processed according to conventional procedures of the art. They may be coated, for example, onto various types of rigid or flexible supports, such as glass, paper, metal, and polymeric films of both the synthetic type and those derived from naturally occurring products. As examples of specific materials which may serve as supports, mention may be made of paper, aluminum, polymethacrylic acid, methyl and ethyl esters, vinylchloride polymers, polyvinyl acetal, polyamides such as nylon, polyesters such as polymeric film derived from ethylene glycol-terephthalic acid, and cellulose derivatives such as cellulose acetate, triacetate, nitrate, propionate, butyrate, acetate propionate, and acetate butyrate. Suitable subcoats may be provided on the supports, for example a layer of gelatin, if necessary or desirable for adherence, as is well known in the art.

The polymers employed in the practice of the instant invention may contain from 0.5–100 mole % of the above-indicated repeating units. The specific amount employed may be selected by the operator depending upon the grain particle size and habit desired.

By selecting appropriate comonomers, the instant copolymers may be made to be compatible with all water-soluble bodying polymers. Emulsions made from these novel polymers, may be bodied with any water-soluble polymers, overcoming the disadvantage encountered with gelatin which is only compatible with a very few polymers in a most limited pH range. As examples of specific materials which may serve as bodying polymers are gelatin, polyvinyl alcohol, polyacrylamide, polyalkylacrylamides, polyvinyl pyrrolidone, polymethacrylamidoacetamide, vinyl alcohol/N-vinylpyrrolidone copolymers, poly-N-ethylaziridine, poly-N-(2-hydroxyethyl) aziridine, poly-N-(2-cyanoethyl) aziridine, poly($\beta$-hydroxyethyl acrylate), polyethylene imine and cellulose derivitives such as hydroxyethyl cellulose, hydroxypropyl cellulose and methyl cellulose. It has been found that using only a small amount of one or more of the instant polymers, large amounts of photosensitive silver halide grains may be obtained.

An emulsion made from one of these polymers of the instant invention may therefore be bodied with a water-soluble polymer such that the polymeric constitution of the resulting emulsion comprises a relatively large percentage of the bodying polymer.

By selecting appropriate comonomers, copolymers with selected diffusion characteristics may be prepared. For example, the rate of diffusion of alkali ion or a dye developer through an emulsion comprising one of the polymers of this invention may be modified by varying the composition of the polymer.

The instant polymers containing acidic comonomers may be pH flocculated in order to remove the soluble salts formed as a byproduct of the double decomposition reaction between the water-soluble silver salt and the water-soluble halide, in addition to any unreacted excess of the initial salts. As an example, an acid copolymer may be precipitated by lowering the pH below 5 and then washed and resuspended by raising the pH to above 7.

The instant invention will be further illustrated by reference to the following nonlimiting examples:

EXAMPLE III

A solution of about 2.08 g of a dry copolymer of acrylamide/N-vinyl-t-butylcarbamate as prepared in Example I above, in 133 ml of distilled water was adjusted to pH 3.0 with dilute nitric acid and maintained at a temperature of 55° C. To this solution, 22.0 g of dry potassium bromide and 0.25 g of dry potassium iodide were added.

A solution of 27.5 g of silver nitrate in 250 ml of distilled water was prepared. From this silver nitrate solution, 50 ml was rapidly added with continuous agitation to the polymer-halide solution and the remainder was added over a period of 22 minutes. Thereafter, the emulsion was ripened for 30 minutes at 55° C, and then rapidly cooled to below 20° C.

EXAMPLE IV

A solution of 4.15 g of dry poly-N-vinyl-5-methyl-2-oxazolidinone (commercially available from Dow Chemical Company, Midland, Michigan) in 266 ml of distilled water was adjusted to pH 6.30 dilute nitric acid and maintained at a temperature of 55° C. To this solution, 44.0 g of dry potassium bromide and 0.50 g of dry potassium iodide were added.

A solution of 55 g of silver nitrate in 500 ml of distilled water was prepared. From this silver nitrate solution, 100 ml was rapidly added with continuous agitation to the polymer-halide solution and the remainder was added over a period of 22 minutes. Thereafter, the emulsion was ripened for 30 minutes at 55° C, and then rapidly cooled to below 20° C.

EXAMPLE V

A solution of 4.15 g of a dry 2:3 copolymer of vinyl alcohol/N-vinyl-5-methyl-2-oxazolidinone as prepared in Example II above, in 266 ml of distilled water was adjusted to pH 3.0 with dilute nitric acid and maintained at a temperature of 55° C. To this solution, 88.0 g of dry potassium bromide were added.

A solution of 55 g of silver nitrate in 500 ml of distilled water was prepared. From this silver nitrate solution, 100 ml was rapidly added with continuous agitation to the polymer-halide solution and the remainder was added over a period of 22 minutes. Thereafter, the emulsion was ripened for 60 minutes at 55° C, and then rapidly cooled to below 20° C.

EXAMPLE VI (control)

A silver halide emulsion was prepared according to the procedure of Example IV except that gelatin was employed as the emulsion peptizer.

The following table summarizes the silver halide grain sizes obtained in the emulsions prepared above, all of which contained octahedral platelet crystals.

TABLE 1

| Example | Polymer | Approximate Grain size (microns) Range | Average |
|---|---|---|---|
| III | 1:1 acrylamide/N-vinyl-t-butylcarbamate | 0.2–2.0 | 0.8 |
| IV | poly-N-vinyl-5-methyl-2-oxazolidinone | 0.3–2.0 | 0.7 |
| V | 2:3 vinyl alcohol/N-vinyl-5-methyl-2-oxazolidinone | 0.4–2.2 | 1.2 |

TABLE 1-continued

| Example | Polymer | Approximate Grain size (microns) Range | Average |
|---|---|---|---|
| VI | gelatin | 0.2–1.8 | 1.0 |

EXAMPLE VII

The emulsion mixture of Example IV was centrifuged and washed with water to a low conductance and then redispersed in distilled water. The emulsion was then bodied with gelatin to give a silver to gelatin ratio of about 1:1.09. A surfactant, Aerosol OT, was added and the emulsion was slot coated at a silver coverage of 8.8 mg Ag per square foot onto a base of cellulose triacetate sheet 5 mils thick subcoated with 30 mg per square foot of hardened gelatin. This film so prepared was air dried, exposed on a sensitometer, and processed with a processing solution and an image-receiving sheet from a Polaroid Type 20C Land film assembly (Polaroid Corporation, Cambridge, Massachusetts). The negative and image-receiving element were maintained in superposed position for 10 seconds after which they were stripped apart. Reflection densities of the resulting positive print were then measured by an automatic recording densitometer to be:

$D_{max}$ - 1.13
$D_{min}$ - 0.53
$\Delta D$ - 0.60

The term "photosensitive" and other terms of similar import are herein employed in the generic sense to describe materials possessing physical and chemical properties which enable them to form usable images when photoexposed by radiation actinic to silver halide.

Since certain changes may be made in the above products and processes without departing from the scope of the invention herein involved, it is intended that all matter contained in the above description shall be interpreted as illustrative only and not in a limiting sense.

What is claimed is:

1. A photosensitive silver halide emulsion wherein the silver halide grains have adsorbed on their surface a substantially continuous layer of an emulsion peptizer consisting essentially of a water-soluble film-forming polymeric silver halide grain-growing protective colloid having in its structure at least about 0.5 mole percent repeating units of the formula:

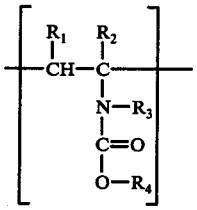

wherein $R_1$ is hydrogen, a lower alkyl group or a halogen;

$R_2$ is hydrogen, a lower alkyl group, halogen or cyano group;

$R_3$ is hydrogen, a lower alkyl or lower cycloalkyl group; and $R_4$ is a lower alkyl or lower cycloalkyl group, or a combination of $R_3$ and $R_4$ represents the atoms necessary to complete a heterocyclic ring structure.

2. The product as defined in claim 1 wherein said silver halide emulsion is a silver iodobromide emulsion.

3. The product as defined in claim 1 wherein said polymeric grain-growing protective colloid is a homopolymer.

4. The product as defined in claim 3 wherein said homopolymer is poly-N-vinyl-5-methyl-2-oxazolidinone.

5. The product as defined in claim 1 wherein said polymeric grain-growing protective colloid comprises a copolymer of a first monomer of the formula:

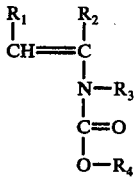

and a second ethylenically unsaturated monomer.

6. The product as defined in claim 5 wherein said first monomer is N-vinyl-5-methyl-2-oxazolidinone.

7. The product as defined in claim 5 wherein said first monomer is N-vinyl-5-t-butylcarbamate.

8. The product as defined in claim 5 wherein said second monomer is acrylamide.

9. The product as defined in claim 5 wherein said second monomer is vinyl alcohol.

10. The product as defined in claim 1 which includes a bodying polymer.

11. The product as defined in claim 10 wherein said bodying polymer is polyvinyl alcohol.

12. A process for preparing a photosensitive silver halide emulsion which comprises reacting a water-soluble silver salt with a water-soluble halide salt in an aqueous solution containing a silver halide peptizer, said peptizer consisting essentially of a water-soluble film-forming polymeric silver halide grain-growing protective colloid having in its structure at least about 0.5 mole percent repeating units of the formula:

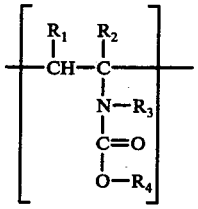

wherein $R_1$ is hydrogen, a lower alkyl group or a halogen; $R_2$ is hydrogen, a lower alkyl group, a halogen or cyano group; $R_3$ is hydrogen, a lower alkyl or lower cycloalkyl group, and $R_4$ is a lower alkyl group or lower cycloalkyl group; or a combination of $R_3$ and $R_4$ represents the atoms necessary to complete a heterocyclic ring structure.

13. The process as defined in claim 12 wherein said polymeric grain-growing protective colloid is poly-N-vinyl-5-methyl-2-oxazolidinone.

14. The process as defined in claim 12 wherein said polymeric grain-growing protective colloid comprises a copolymer of a first monomer of the formula:

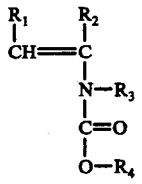

and a second ethylenically unsaturated monomer.

15. The process as defined in claim 14 wherein said first monomer is N-vinyl-5-methyl-2-oxazolidinone.

16. The process as defined in claim 14 wherein said first monomer is N-vinyl-5-t-butylcarbamate.

17. The process as defined in claim 14 wherein said second monomer is acrylamide.

18. The process as defined in claim 14 wherein said second monomer is vinyl alcohol.

19. The process as defined in claim 12 wherein said aqueous solution includes a bodying polymer.

20. The process as defined in claim 19 wherein said bodying polymer is polyvinyl alcohol.

* * * * *